US005671496A

United States Patent [19]

Smith

[11] Patent Number: 5,671,496

[45] Date of Patent: Sep. 30, 1997

[54] PORTABLE WHEEL CHAIR RAMP

[76] Inventor: Allan Smith, 43 Sir Ross Smith Avenue, North Haven, SA 5018, Australia

[21] Appl. No.: 556,796

[22] Filed: Nov. 2, 1995

[30] Foreign Application Priority Data

Jun. 15, 1992 [AU] Australia ..... PL2918

[51] Int. Cl.[6] ..... E01C 5/00

[52] U.S. Cl. ..... 14/69.5; 254/88; 160/231.1; 404/35

[58] Field of Search ..... 14/69.5, 2.4; 404/17, 404/18, 34, 35; 254/88; 52/71, 177; 160/35, 36, 84.01, 133, 135, 231.1, 231.2

[56] References Cited

U.S. PATENT DOCUMENTS

| | | | |
|---|---|---|---|
| 1,846,202 | 2/1932 | Hough | 160/231.1 |
| 1,944,696 | 1/1934 | Reichl | 160/135 |
| 3,284,819 | 11/1966 | Nissen | 404/35 |
| 3,818,528 | 6/1974 | Petersen . | |
| 3,936,898 | 2/1976 | Poe . | |
| 5,282,692 | 2/1994 | McLeod | 404/35 |
| 5,354,589 | 10/1994 | Wass | 160/231.1 X |

OTHER PUBLICATIONS

Supplementary European Search Report.

*Primary Examiner*—James Lisehora
*Attorney, Agent, or Firm*—Fish & Richardson P.C.

[57] ABSTRACT

A wheel chair ramp comprises a plurality of leaves extending in the direction of intended use of the ramp. The leaves are joined together by flexible hinges so that the leaves may be folded to a stalked condition. The flexible hinges are formed by fabric straps attached to the sides of the leaves and passing between adjacent leaves.

7 Claims, 2 Drawing Sheets

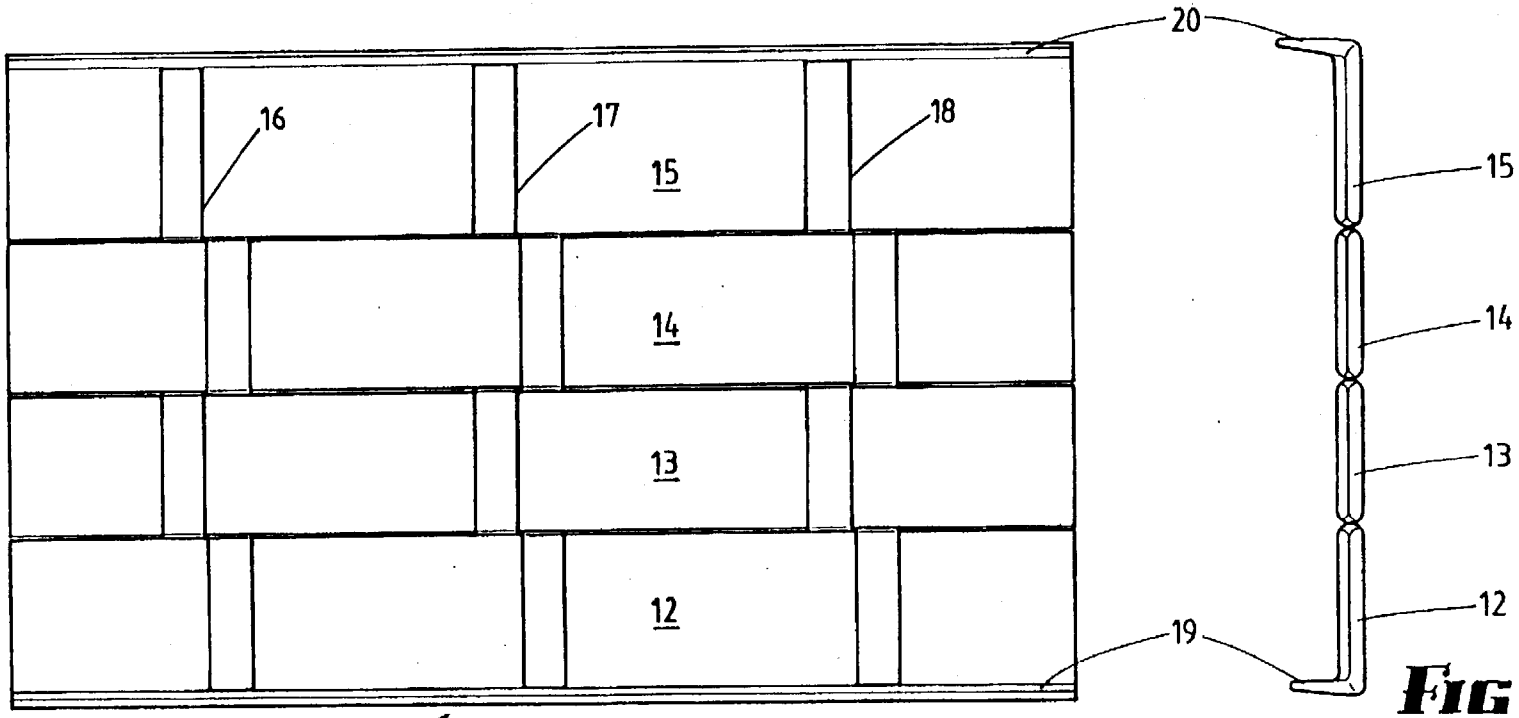
FIG 5
FIG 3
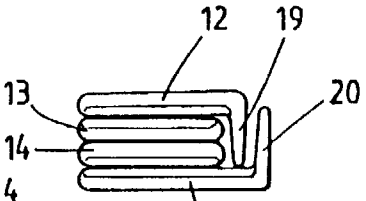
FIG 6
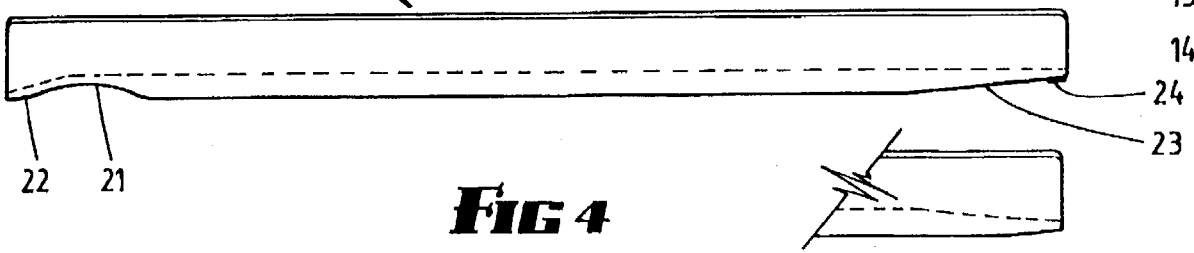
FIG 4

PORTABLE WHEEL CHAIR RAMP

This application is a continuation of International Application No. PCT/AU93/00280, filed Jun. 15, 1993, now abandoned.

This invention relates to an improved wheel chair ramp, more particularly to a ramp which is easily collapsible, light and easily handled.

BACKGROUND OF THE INVENTION

Although many buildings and civil works incorporate in their construction ramps for use by the occupants of wheel chairs, there are many buildings areas, gutters, steps, drains and the like which can impede or prevent the passage of a wheel chair.

Another area where the users of wheel chairs have great problems is in the boarding and the alighting from vehicles, particularly trains buses and motor vehicles. Although some buses and taxis are especially fitted to accommodate wheel chairs with the occupant seated in the wheel chair, access is still required into the vehicle. While trains and railway station platforms are designed to have a reasonable step for able bodied persons, this step still prevents the user of a wheel chair from boarding and alighting from the train.

GB 1,572,466 describes a portable ramp for wheel chairs comprising two spaced parallel track members directly interconnected by a collapsible parallel pivotal linkage such that when collapsed the track members lie closely side by side for transport and/or storage when the ramp is not in use. While such a ramp is of assistance, it has the disadvantage that the wheels of the wheel chair must be aligned with the track members, and that the wheel chair cannot move along the ramp at an angle which may be desirable in some in situations. Also there is no provision for the helper to walk on the ramp while helping the occupant negotiate the ramp. Further more the ramp, while being collapsible increases the effective storage length when folded due to the folding of the toggle linkage between the two track members.

Patent No AU 591302 discloses a wheel chair ramp which is foldable and portable, and has a degree of flexibility extending from, when in use, a lower edge to an upper edge. However this ramp has been found to be relatively expensive to produce and maintenance is required to the hinge attachments after a period of use. The ramp has three relatively wide portions hinged together by continuous hinges, such as piano hinges, and to provide a degree of flexibility to accommodate for use on uneven surfaces or non-parallel surfaces, each of the portions has been provided with a limited action flexible hinge extending diagonally of the portion. This greatly increases the construction costs of the ramp, and the three portions when folded result in a relatively wide unit for storage.

Thus it is an object of this invention to provide a wheel chair ramp which will over come one or more of the disadvantages of the prior art ramps.

It is a further object of this invention to produce a wheel chair ramp which is simple to produce, requires little or no maintenance, is relatively light, and easily positioned for use.

A further object of the invention is to provide a wheel chair ramp which is foldable for handling and storage and has safety edges to prevent the wheel chair from running off the edge of the ramp.

BRIEF STATEMENT OF THE INVENTION

Thus there is provided according to the invention a portable wheel chair ramp, the ramp having at least two leaves hinged together so that the hinge line extends in the direction of intended passage of a wheel chair, said hinges being formed by fabric strips attached to respective adjacent leaves and extending between the respective adjacent leaves.

In a further form of the invention there is a provided a portable wheel chair ramp, the ramp including four longitudinal leaves hinged together by flexible fabric hinges, the outer edge of the two outer leaves each having an upstanding ledge or flange, the width of the leaves being so dimensioned that the leaves may be folded one on the other.

BRIEF DESCRIPTION OF THE DRAWINGS

In order to more fully describe the invention reference will now be made to the accompanying drawings in which:

FIG. 3 shows in plan an alternate form of the invention,

FIG. 4 shows the ramp of FIG. 3 in elevation,

FIG. 5 is an end elevation of the ramp of FIG. 4, and

FIG. 6 shows the ramp in end elevation in the folded position.

DESCRIPTION OF THE PREFERRED EMBODIMENT.

Figure 1:
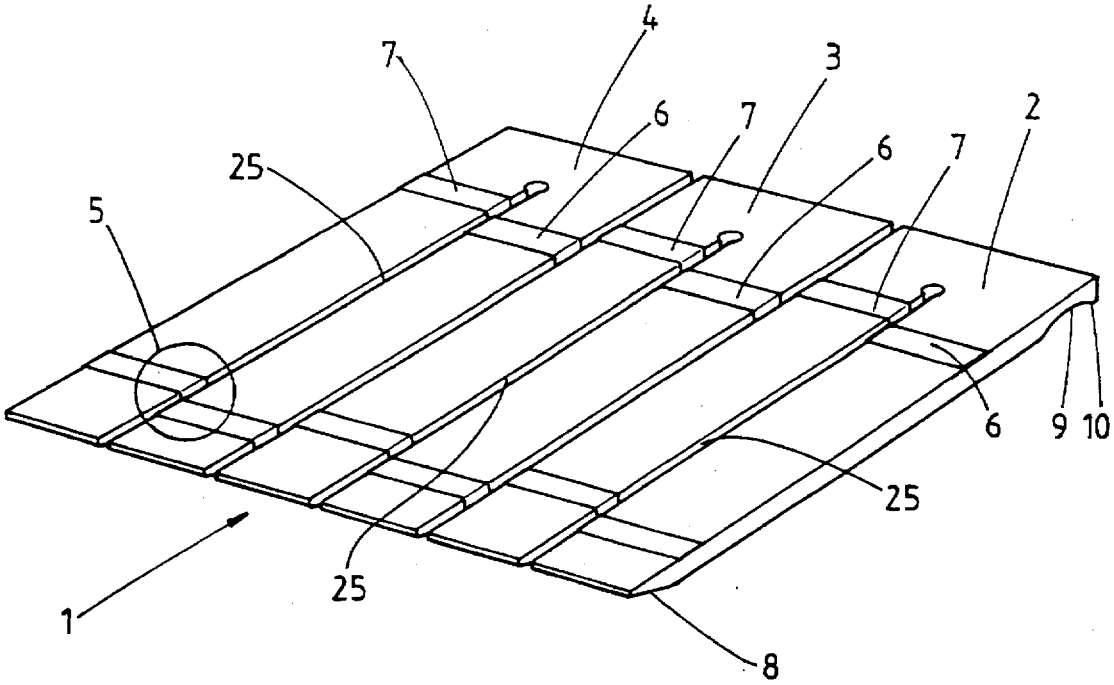
FIG. 1 shows one form of the invention in the unfolded position.
Figure 2:
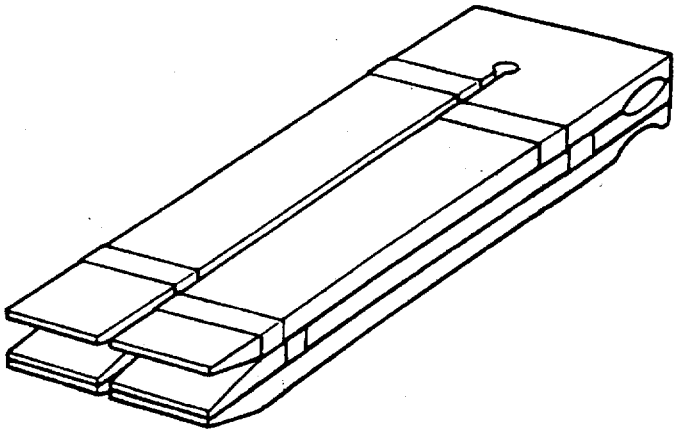
FIG. 2 shows the ramp in the folded position for storage and transport.

In the example shown in FIGS. 1 and 2, the ramp 1 comprises three leaves 2, 3 and 4 which are formed of a light weight strong material. In the present invention the leaves are formed of a rigid foam material covered in reinforced fibreglass material This produces a strong light weight material, the reinforced fibre glass covering providing a durable hard wearing weather-proof surface to the leaves.

The leaves are hinged together by straps of a flexible fabric like material. In the present invention the hinges 5 are formed of seat belt webbing which is very flexible, is not prone to fatigue under repeated flexing and yet has great tensile strength. Each hinge comprises a pair straps attached to one side of one leaf which then passes between the two adjacent leaves and is then attached to the opposite side of the adjacent leaf. Thus as shown in FIG. 1 at each hinge point between leaves 4 and 3, the strap 6 is attached to the upper surface of leaf 4 and then passes between the leaves and is attached to the lower surface of leaf 3. Strap 7 is attached to the lower surface of leaf 4 and then passes between the leaves 3 and 4 and is attached to the upper surface of leaf 3. The two straps 6 and 7 thus combine to form the hinge, the straps being positioned adjacent each other so that the straps where they pass between the adjacent leaves are very close and nearly in contact with each other.

As shown in FIG. 1, to provide a degree of flexibility to the leaves where this may be desired, each leaf is provided with a longitudinal slot 25 which extends from one end of each leaf to terminate at a distance from the other end. Thus each slot may be ¾ to ⁴⁄₅/ of the length of each leaf, which thus allows each leaf to have a degree of flexibility. In order to tie the leaves together as a unit while providing for the desired flexibility, the hinge straps pass across each leaf but in so doing pass through these slots so that the straps pass from one side of each leaf to the other.

Thus it is preferred that each strap is continuous from one side of the ramp to the other. It is also preferred that the straps be placed in position before the glass fibre is applied, the glass fibre thus adhering the straps to the leaves and also providing a protective covering to the straps.

Each leaf has a taper 8 at one end so that the ramp would rest on the lower surface with only a small step from the lower surface to the ramp. The leaves at the other end are provided with a shallow curved surface 9 having a nose 10 which assists in locating the ramp on the upper surface.

FIGS. 3 to 6 show a further form of the invention wherein the leaves are not provided with a longitudinal slot. The ramp 11 comprises four leaves, 12, 13, 14 and 15 which are hinged together along hinge lines 16, 17 and 18 in the same manner as described above, but without the central slot for providing a degree of flexibility. Thus in this instance the straps continue over the entire width of one side of each leaf and then pass between the adjacent leaves to pass over the entire width of the adjacent leaf on the side opposite to the previous leaf.

In this embodiment the outer edge of leaf 12 and the outer edge of leaf 15 are provided with safety ledges 19 and 20 respectively. These ledges thus provide a guide and barrier to act as a safety barrier against a wheel chair running off the edge of the ramp.

In this embodiment, the two central leaves 13 and 14 have the same width, and in order to allow these leaves to fold and nest into an outer leaf, one outer leaf, such as leaf 12, is of greater width. Also to allow folding and nesting of leaf 12, leaf 15 is of greater width than leaf 12, and as will be seen in FIG. 6, the two ledges 19 and 20 extend inwardly toward the folded leaves, with ledge passing on the inside of the ledge 20.

Thus it will be seen that by the invention there is provided a small light weight portable ramp. The ramp may be made in any suitable length, and could be small enough to be carried in a carrier in or an a wheel chair. Other units can be carried on a vehicle such as a carriage of a train, where the ramp can be used and quickly put in position so that a person in a wheel chair can board or alight from a train.

The ramp can be folded from either side, and by the folding the leaves nest one on the other with the ledges also nesting, to form a convenient and easily handled unit.

As shown in FIG. 4, the end of the ramp which would be the upper end when in use has a recessed portion 21 to the upper end of which is provided a grip or other wear and locating member 22. At the other end of the ramp the underside has a taper 23 and is also fitted with a grip and wear resisting material 24. Two examples are shown of this portion of the ramp.

The ramp with the side edges is easily folded and handled and can be formed in any suitable length, the side ledges thus assisting in preventing the wheel chair from running off the edge of the ramp and providing security for the user.

Although various forms of the invention have been described in some detail, the invention is not to be limited thereto, but can include variations and modifications falling within the spirit and scope of the invention.

I claim:

1. A portable wheel chair ramp, the ramp having at least two leaves hinged together by at least two hinges that form a hinge line that extends in the direction of intended passage of a wheel chair, said hinges being formed by fabric strips attached to respective adjacent leaves and extending between the respective adjacent leaves, wherein a first strip is attached to a first side of a first leaf and extends between the first leaf and a second leaf and is attached to a second side of the second leaf, and a second strip is attached to the second side of the first leaf and extends between adjacent leaves and is attached to the first side of the second leaf.

2. A portable wheel chair ramp as defined in claim 1, wherein each of the straps extends continuously from one side of the ramp to the other passing respectively on said first and second sides of the respective leaves.

3. A portable wheel chair ramp as defined in claim 1, wherein each of the leaves is provided with a longitudinal slot opening to one end of each leaf and terminating adjacent the other end of each respective leaf.

4. A portable wheel chair ramp as defined in claim 3 wherein each of the straps forming the respective hinges passes through the slot of each respective leaf.

5. A portable wheel chair ramp as defined in claim 3 wherein the outside edge of each outside leaf is provided with an upstanding ledge.

6. A portable wheel chair ramp as defined in claim 3 wherein each of the leaves is graduated in width so that the leaves will nest when in a folded condition.

7. The portable chair ramp of claim 1, wherein the ramp comprises four longitudinal leaves hinged together by said fabric strips, an outer edge of each of the two outer leaves has an upstanding ledge or flange, and the four leaves have widths which are dimensioned such that the four leaves can be folded in accordion fashion.

* * * * *